US008091402B2

(12) United States Patent
Hanafusa et al.

(10) Patent No.: US 8,091,402 B2
(45) Date of Patent: Jan. 10, 2012

(54) METHOD OF MANUFACTURING BOTTLE CAN

(75) Inventors: Tatsuya Hanafusa, Gotenba (JP); Ryoichi Ito, Gotenba (JP); Masahiro Hosoi, Gotenba (JP)

(73) Assignee: Universal Can Corporation, Tokyo (JP)

( * ) Notice: Subject to any disclaimer, the term of this patent is extended or adjusted under 35 U.S.C. 154(b) by 533 days.

(21) Appl. No.: 11/722,227

(22) PCT Filed: Sep. 20, 2005

(86) PCT No.: PCT/JP2005/017265

§ 371 (c)(1),
(2), (4) Date: Jun. 20, 2007

(87) PCT Pub. No.: WO2006/067901

PCT Pub. Date: Jun. 29, 2006

(65) Prior Publication Data

US 2009/0211329 A1 Aug. 27, 2009

(30) Foreign Application Priority Data

Dec. 24, 2004 (JP) ..... 2004-373165

(51) Int. Cl.

| | |
|---|---|
| ***B21D 11/10*** | (2006.01) |
| ***B21D 15/04*** | (2006.01) |
| ***B21D 51/02*** | (2006.01) |
| ***B21H 3/04*** | (2006.01) |
| ***B65D 6/00*** | (2006.01) |

(52) U.S. Cl. ..... 72/379.4; 72/103; 72/105; 72/715; 220/669

(58) Field of Classification Search ..... 72/379.4, 72/103–105, 349, 715; 220/669, 670
See application file for complete search history.

(56) References Cited

U.S. PATENT DOCUMENTS 5,704,240 A 1/1998 Jordan

FOREIGN PATENT DOCUMENTS

| | | |
|---|---|---|
| EP | 1247750 | 10/2002 |
| EP | 1468925 | 10/2004 |
| JP | 47-6441 | 3/1972 |
| JP | A-11-100018 | 4/1999 |
| JP | 2000-191006 A | 7/2000 |
| JP | 2001-121230 A | 5/2001 |
| JP | 2001-213416 A | 8/2001 |

(Continued)

OTHER PUBLICATIONS

JP2004074168 English Abstract.*

(Continued)

*Primary Examiner* — Edward Tolan
*Assistant Examiner* — Mohammad Ibrahim Yusuf
(74) *Attorney, Agent, or Firm* — Leason Ellis LLP.

(57) ABSTRACT

In this bottle can manufacturing method, when a portion located at the skirt portion 7 is being molded, the portion extending in an opposite direction in which the male threaded portion 6 extends from a lower end 6*a* of the male threaded portion 6 over a range of at least approximately 180° along a circumferential direction of the skirt portion 7, the inner surfaces of molding pre-form portions of the first circumferential wall portion and the convexly curved surface portion from among the molding pre-form portions of the skirt portion 7 are pressed outward in the radial direction of the bottle can body.

8 Claims, 7 Drawing Sheets

FOREIGN PATENT DOCUMENTS

| | | | | |
|---|---|---|---|---|
| JP | 2002-066674 | A | | 3/2002 |
| JP | 2002-219539 | A | | 8/2002 |
| JP | 2003-094133 | | | 4/2003 |
| JP | 2003-154426 | A | | 5/2003 |
| JP | 2004-074170 | A | | 3/2004 |
| JP | 2004074168 | | * | 3/2004 |
| JP | 2004-130386 | A | | 4/2004 |
| JP | 2004-148403 | A | | 5/2004 |
| JP | 2004-155487 | A | | 6/2004 |
| JP | 2004-160468 | A | | 6/2004 |
| JP | A-2004-175386 | | | 6/2004 |
| JP | 2004-223614 | A | | 8/2004 |
| JP | 2005-52890 | A | | 3/2005 |
| WO | WO-03047991 | | | 6/2003 |

OTHER PUBLICATIONS

Japanese Office Action issued on Aug. 31, 2010 for the corresponding Japanese application No. 2004-373165.

* cited by examiner

METHOD OF MANUFACTURING BOTTLE CAN

TECHNICAL FIELD

The present invention relates to a bottle can manufacturing method.

CROSS-REFERENCE TO PRIOR APPLICATION

This is a U.S. National Phase Application under 35 U.S.C. §371 of International Patent Application No. PCT/JP2005/017265 filed Sep. 20, 2005, and claims the benefit of Japanese Patent Application No. 2004-373165, filed Dec. 24, 2004, both of which are incorporated by reference herein. The International Application was published in Japanese on Jun. 29, 2006 as WO 2006/067901 A1 under PCT Article 21(2).

BACKGROUND ART OF THE INVENTION

Generally, bottle cans that are filled with drinks and the like are formed in the following manner.

Firstly, as shown in FIG. 7A, a close-ended cylindrical body 1 is formed by performing drawing processing and ironing processing on a metal plate made of aluminum alloy or the like. Next, neck-in processing is performed on the aperture portion of the cylindrical body 1. As a result, as shown in FIG. 7B, a bottle can body 5 is formed that is provided with a large diameter drum portion 2, a shoulder portion 3 that is joined to a top end in the can axial direction of the drum portion 2 and whose diameter gradually narrows as it moves upwards, and a pipe sleeve portion 4 that is joined to a top end of the shoulder portion 3 and extends upwards. In addition, as shown in FIG. 7C, in the pipe sleeve portion 4 of the bottle can body 5, after the diameter of portions excluding a bottom portion 4*a* has first been widened, diameter-narrowing processing is performed on the wide diameter portion with the position of the processing shifted sequentially upwards in the can axial direction. As a result, the bottle can body 5 shown in FIG. 7D is formed.

The pipe sleeve portion 4 of this bottle can body 5 is provided with a skirt molding pre-form portion 4*b* that is joined to a top end in the can axial direction of the pipe sleeve portion bottom portion 4*a* and bulges outwards in the radial direction, a male threaded molding pre-form portion 4*c* that is joined to a top end of the skirt molding pre-form portion 4*b* and extends upwards, and a curl molding pre-form portion 4*d* that is joined to a top end of the male threaded molding pre-form portion 4*c* and has a narrower diameter than the molding pre-form portion 4*c*. Note that the top end portion in the can axial direction of the pipe sleeve portion bottom portion 4*a* forms a neck portion molding pre-form portion 4*e* that has a narrower diameter than the skirt molding pre-form portion 4*b*.

Next, as shown in FIG. 8, a spiral male threaded portion 6 is formed in the male threaded molding pre-form portion 4*c* of the pipe sleeve portion 4 of the bottle can body 5, an internal surface of the skirt molding pre-form portion 4*b* is pressed towards the outer side in the radial direction, and thereby a skirt portion 112 has been molded. Thereafter, a curl portion 8 is molded by bending the curl molding pre-form portion 4*d* outwards in the radial direction. As a result, a bottle can 110 having a pipe sleeve portion 111 is formed. As shown in FIG. 8, the skirt portion 112 has a schematic structure that is provided with a first circumferential wall portion 112*a* whose diameter becomes gradually wider as it moves downwards in the can axial direction, and with a second circumferential wall portion 112*c* that is joined to a bottom end of the first circumferential wall portion 112*a* via a convexly curved surface portion 112*b* which protrudes towards the outer side in the radial direction, and whose diameter becomes gradually narrower as it moves downwards.

Note that in the skirt portion 112, conventionally, only the molding pre-form portion of the convexly curved surface portion 112*b* of the internal surface of the skirt molding pre-form portion 4*b* is pushed towards the outer side in the radial direction, and respective molding pre-form portions of the first circumferential wall portion 112*a* and the second circumferential wall portion 112*c* are deformed so as to follow the deformation towards the outer side in the radial direction of this molding pre-form portion, and are then molded into the first circumferential wall portion 112*a* and the second circumferential wall portion 112*c*. As a result of this, the skirt portion 112*b* is molded. Moreover, structures disclosed in Patent Document 1 given below are known for the apparatus and method that are used to mold the male threaded portion 6.

PATENT DOCUMENT 1: Japanese Patent Application, First Publication, No. 2002-219539

DETAILED DESCRIPTION OF THE INVENTION

Problems to be Solved by the Invention

In the above described structure, due to the spiral shape of the male threaded portion 6, the size a in the can axial direction of the skirt portion 112 is not fixed in the circumferential direction, and, as shown in FIG. 8, the portion that is located at a lower end 6*a* of the bottom end in the can axial direction of the male threaded portion 6 (referred to below as 'position A in the circumferential direction') is the smallest, and the size a becomes gradually larger as it moves in a direction X in which the male threaded portion 6 extends in the circumferential direction from the position A. In addition, this size a is the largest at the portion of the lower end 6*a* of the male threaded portion 6 that is located in the vicinity of the opposite side from the extending direction X (referred to below as 'position B in the circumferential direction'). Specifically, of the first circumferential wall portion 112*a*, the convexly curved surface portion 112*b*, and the second circumferential wall portion 112*c* that make up the skirt portion 112, only the size of the first circumferential wall portion 112*a* in the can axial direction differs in the circumferential direction in the manner described above.

Due to these discrepancies in the size a in the circumferential direction of the skirt portion 12, in the above described conventional skirt portion molding method, the problem has existed that it has been difficult to accurately mold the skirt portion 112 over its entire circumference. Specifically, the problem has existed that a radius of curvature R of the skirt portion 112 (i.e., of the convexly curved surface portion 112*b*) at the position A in the circumferential direction, as well as a skirt angle (i.e., an angle formed by the outer circumferential surface of the second circumferential wall 112*c* or by a tangent thereof in a direction that is orthogonal to the can axis) θ are the smallest on this skirt portion 112 and are molded with the highest degree of accuracy, and they become gradually larger as they move in the X direction in which the male threaded portion 6 extends, namely, sagging is generated and there is a reduction in the molding accuracy, so that at the position B in the circumferential direction the radius of curvature R and the skirt angle θ are the largest and are molded with the lowest degree of accuracy.

In a capped bottle can that has a cap screwed onto the above described bottle can 110, when the cap is loosened, the bridge of the cap that is placed on the skirt portion 112 of the bottle can 110 cannot be properly severed, and the cap is opened with the cap flare having an enlarged diameter so that it is difficult to reseal this bottle can 110.

Moreover, due to discrepancies in the dimensions of the radius of curvature R and skirt angle θ in the circumferential direction of the bottle can 110, the buckling strength of the skirt portion 112 of the pipe sleeve portion 11 of the bottle can 110 is different at each position in the circumferential direction of the bottle can 110. As a result, after the bottle can 110 has been filled with contents, in a capping step to screw the cap back onto the pipe sleeve portion 111, the possibility arises that the accuracy with which the cap is crewed back onto the pipe sleeve portion 11 will be different at each position in the circumferential direction.

Namely, in the capping step, after the pipe sleeve portion 111 of the bottle can 110 has been covered by the cap, when the outer circumferential edge portion of the cap top plate is pressed downwards in the can axial direction over its entire circumference, because the buckling strength is great in those portions of the skirt portion 112 where R and θ are large, the shape of the skirt portion 112 is maintained. In contrast, because the buckling strength is small in those portions of the skirt portion 112 where R and θ are small, the skirt portion 112 is deformed so as to be crushed downwards in the can axial direction, and there is a possibility that the pipe sleeve portion 111 will be tilted relative to the can axis. Accordingly, in the circumferential direction of a capped bottle can, for example, in portions where R and θ are large, a high sealing performance is achieved, while in portions where R and θ are small, there is a possibility that a high sealing performance will not be achieved.

The present invention was conceived in view of the above described circumstances and it is an object thereof to provide a bottle can manufacturing method that makes it possible to accurately mold a skirt portion onto a pipe sleeve portion.

Means for Solving the Problem

In order to solve the above described problems and achieve the above described objects, the bottle can manufacturing method of the present invention includes molding a skirt portion at a pipe sleeve portion of a bottle can body, the skirt portion being provided with: a first circumferential wall portion that is joined to a bottom end of a male threaded portion and whose diameter becomes gradually larger moving downwards in the can axial direction; and a second circumferential wall portion that is joined to a bottom end of the first circumferential wall portion via a convexly curved surface portion which protrudes towards the outer side in the radial direction, and whose diameter becomes gradually smaller as it moves downwards. When a portion located at the skirt portion is being molded, the portion extending in an opposite direction in which the male threaded portion extends from a lower end of the male threaded portion over a range of at least approximately 180° along a circumferential direction of the skirt portion, the inner surfaces of molding pre-form portions of the first circumferential wall portion and the convexly curved surface portion from among the molding pre-form portions of the skirt portion are pressed outward in the radial direction of the bottle can body.

According to the present invention, when a portion of the skirt portion that is located in the area is being molded, because not only the inner surface of the molding pre-form portion of the convexly curved surface portion from among the molding pre-form portion of the skirt portion, but also the inner surface of the molding pre-form portion of the first circumferential wall portion is pressed towards the outer side in the radial direction, it is possible to prevent the shape of the skirt portion that is located in this area from becoming slack.

Namely, the first circumferential wall portion is not molded as a result of only the inner surface of the molding pre-form portion of the convexly curved surface portion being pushed towards the outer side in the radial direction, and the molding pre-form portion of the first circumferential wall portion being deformed as a result of following the deformation behavior towards the outer side in the radial direction of this convex curved surface portion, but instead the first circumferential wall portion is molded by the inner surface of the molding pre-form portion of the first circumferential wall portion being pushed forcefully towards the outer side in the radial direction so that it becomes deformed in this direction. Because of this, even if this pressing is ended after the molding, there is no springback action in the first circumferential wall portion towards the inner side in the radial direction, and the shape during the pressing can be maintained.

Accordingly, it is possible to mold the skirt portion with the radius of curvature of the convexly curved surface portion as well as the angle that is formed in a direction that is orthogonal to the can axis by the outer surface of the second circumferential wall portion or by a tangent thereof having a substantially uniform size over the entire circumference.

As a result of this, when the cap has been loosened, any difficulty in once again resealing the bottle can after the diameter of the flare of the cap was enlarged when the cap was opened that is caused by the bridge of the cap that is placed on the skirt portion of the bottle can not being properly broken off, as well as the screwing accuracy when the cap is screwed onto the pipe sleeve portion being irregular at each position in the circumferential direction in the capping process can both be suppressed.

When a portion of the skirt portion that is located in the area is being molded, it is also possible for the molding pre-form portion of the first circumferential wall portion to be supported from the outer surface side thereof.

In this case, because the molding pre-form portion of the first circumferential wall portion is in a state of being supported from the outer surface side thereof, and the inner surface corresponding to this outer surface is pressed towards the outer side in the radial direction and is molded into the first circumferential wall portion of the skirt portion, during this molding, it is possible to prevent any elongation in the can axial direction that is generated in the outer surface of the molding pre-form portion of the first circumferential wall portion. Accordingly, any deformation towards the outer side in the radial direction of the molding pre-form portion of the first circumferential wall portion as a result of such elongation is blocked, and it is also possible to reliably prevent the springback action from being generated in the first circumferential wall portion.

Moreover, when a portion of the skirt portion that is located in the area is being molded, it is also possible for at least a portion of the outer surface of the molding pre-form portion of the first circumferential wall portion to be pressed towards the inner side in the radial direction, and for a recessed portion that is hollowed out towards the inner side in the radial direction to be formed in the first circumferential wall portion.

In this case, because a recessed portion is formed in the first circumferential wall portion during the molding, the pressing force towards the outer side in the radial direction against the inner surfaces of the respective molding pre-form portions of the first circumferential wall portion and the convexly curved surface portion can be prevented from being dispersed upwardly in the can axial direction above the recessed portion. Accordingly, it is possible to apply this pressing force such that it is concentrated on the respective molding pre-form portions of the bottom portion of the first circumferential wall portion and the convexly curved surface portion that are located below the recessed portion, and it is possible to reliably prevent the shape of the skirt portion that is located in the area from becoming slack.

Note that even though the recessed portion extends continuously in the circumferential direction, it is still possible for it to extend intermittently.

When a cap is screwed onto the pipe sleeve portion of a bottle can after it has been filled with contents, a flare which serves as the free end portion of the cap is molded by being pressed by a sleeve winding roll towards the inner side in the radial direction so as to follow the shape of the outer contour of the skirt portion. The position in the can axial direction of the sleeve winding roll that is used during this molding relative to the bottle can that is set in position for the molding is generally set in the following manner.

Firstly, an image of the pipe sleeve portion of the bottle can is picked up from the side surface thereof by an image pickup device and the contour line of the pipe sleeve portion is captured. In this contour line, an intersection point between an extended line that touches the second circumferential wall portion and a straight line that is parallel with the can axis and touches the convexly curved surface portion is specified, and the distance in the can axial direction between this intersection point and the aperture end surface of the pipe sleeve portion is measured. Based on the measured value, the position in the can axial direction of the sleeve winding roll during the molding is set.

In this type of setting method, the problem has existed that it has been difficult to set the position of the sleeve winding roll with a high degree of accuracy. Namely, the distance in the radial direction between the convexly curved surface portion and the bottom end portion n the can axial direction of the second circumferential wall portion is generally only about 1.2 mm. Moreover, both end portions in the can axial direction of the second circumferential wall portion are formed as curved surfaces, and the straight line portions thereof are only about 0.3 to 0.6 mm. Accordingly, the problem has existed that it has been difficult to specify an extended line that touches the second circumferential wall portion with a high degree of accuracy.

However, in a bottle can obtained using the bottle can manufacturing method of the present invention, because a recessed portion is formed in the first circumferential wall portion, instead of specifying an intersection point between an extended line that touches the second circumferential wall portion and a straight line that is parallel with the can axis and touches the convexly curved surface portion, and then measuring the distance in the can axial direction between this intersection point and the aperture end surface of the pipe sleeve portion, the above described setting can be made by measuring the distance in the can axial direction between the recessed portion and the aperture end surface of the pipe sleeve portion.

Accordingly, because it is easier to specify the recessed portion that the extended line touching the second circumferential wall portion, the setting can be made more easily and with a higher degree of accuracy. Furthermore, this measurement is not limited to a method based on the contour line and it is also possible for it to be made based, for example, on a contact method. By employing a measurement made using this contact method, the measurement can be made with an even higher degree of accuracy. As a result of the above, the position during molding in the can axial direction of the sleeve winding roller can be set easily and with a high degree of accuracy.

Furthermore, when a portion of the skirt portion that is located in the area is being molded, it is also possible for a molding pre-form portion of the second circumferential wall portion to be bent towards the outer side in the radial direction from the inner surface side with a bottom end portion in the axial direction thereof forming a fulcrum.

In this case, when a portion of the skirt portion that is located in the area is being molded, because the molding pre-form portion of the second circumferential wall portion is bent, it is possible to perform work hardening on the bottom end portion in the can axial direction of the second circumferential wall portion that is being molded. Accordingly, when the pressure towards the outer side in the radial direction against the inner surfaces of the respective molding pre-form portions of the first circumferential wall portion and the convexly curved surface portion is released after the molding has been completed, even if a springback action starts to be generated towards the inner side in the radial direction in the first circumferential wall portion and the convexly curved surface portion, the bottom end portion in the can axial direction of the second circumferential wall portion that has undergone the work hardening can be made to act as a reinforced portion that resists the springback action.

Moreover, when a portion of the skirt portion that is located in the area is being molded, it is also possible for at least one of the molding pre-form portion of the convexly curved surface and the molding pre-form portion of the second circumferential surface to be supported from the outer surface side thereof.

If the molding pre-form portion of the convexly curved surface portion is molded while in a state of being supported from the outer surface side thereof and the inner surface that corresponds to this outer surface being pressed towards the outer side in the radial direction, it is possible during this molding to suppress any elongation in the can axial direction that is generated on the outer surface of the molding pre-form portion of the convexly curved surface portion, and any deformation towards the outer side in the radial direction of the molding pre-form portion of the convexly curved surface portion that would have been caused by this elongation is blocked. Alternatively, when the pressure towards the outer side in the radial direction against the inner surface of the molding pre-form portion of the convexly curved surface portion is released after the molding, it is possible to reliably prevent a springback action towards the inner side in the radial direction being generated in the convexly curved surface portion. Moreover, if the molding pre-form portion of the second circumferential wall portion is bent while being supported from the outer surface side thereof, during the molding, it is possible to suppress any compressive strain in the direction in which the longitudinal cross-section configuration extends that is generated on the outer surface of the bottom end portion of the molding pre-form portion of the second circumferential wall portion, and when the bending of the molding pre-form portion of the second circumferential wall portion is released after the molding, it is possible to reliably inhibit the second circumferential wall portion from springing back towards the top in the can axial direction.

Furthermore, when a portion of the skirt portion that is located in the area is being molded, it is also possible for a neck portion molding pre-form portion that is joined to a bottom end in the can axial direction of the molding pre-form portion of the second circumferential wall portion to be molded into a neck portion that is joined to a bottom end of the skirt portion by pressing an outer surface thereof towards the inner side in the radial direction while the neck portion molding pre-form portion is supported from the inner surface side thereof.

In this case, because the neck portion molding pre-form portion is molded while in a state of being supported from the inner surface side thereof and with the outer surface that corresponds to this inner surface being pressed towards the inner side in the radial direction, it is possible during this molding to suppress any elongation in the can axial direction that is generated on the inner surface of the neck portion molding pre-form portion, and any deformation towards the inner side in the radial direction of the neck portion molding pre-form portion that would have been caused by this elongation is blocked. Alternatively, when the pressure towards the inner side in the radial direction against the outer surface of the molding pre-form portion of the neck portion is released after the molding, it is possible to reliably prevent a springback action towards the outer side in the radial direction being generated in the neck portion. Accordingly, it is possible to mold the neck portion with a high degree of accuracy, and prevent any distortion in the shape of the neck portion from affecting the skirt portion. It is therefore possible to mold an extremely accurate skirt portion with an even greater level of reliability.

ADVANTAGEOUS EFFECTS OF THE INVENTION

It is possible to accurately mold a skirt portion onto a pipe sleeve portion.

DESCRIPTION OF THE REFERENCE SYMBOLS

Figure 1:
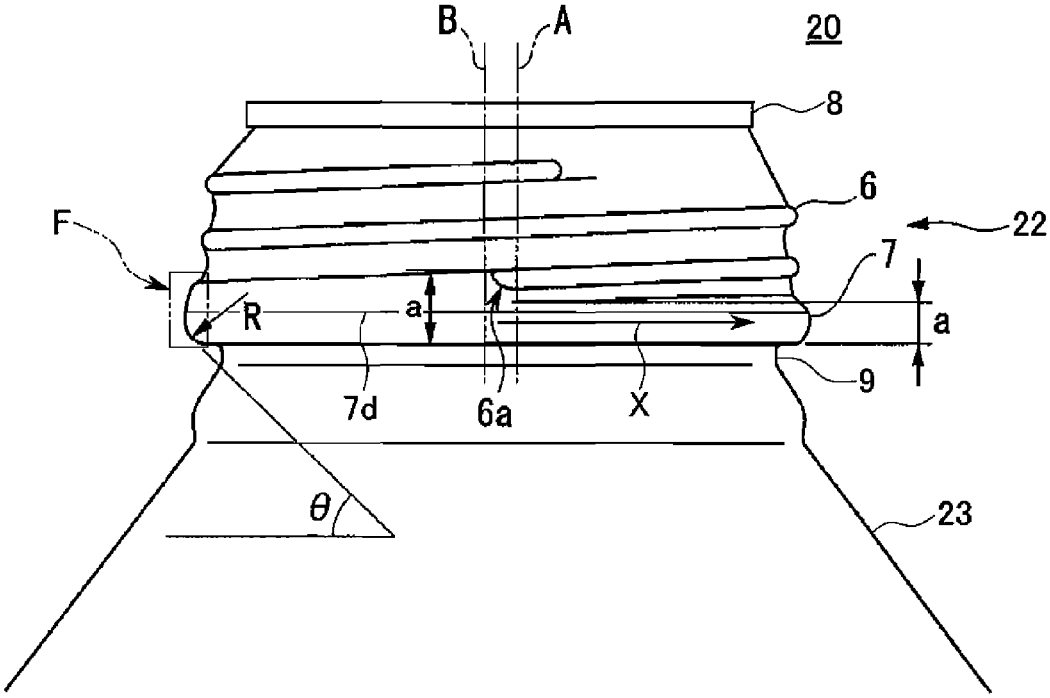
FIG. 1 is an enlarged side surface view showing a bottle can formed using the bottle can manufacturing method as an embodiment of the present invention.

4 Pipe sleeve portion of a bottle can body
4*b* Skirt molding pre-form portion
4*e* Neck portion molding pre-form portion
5 Bottle can body
6 Male threaded portion
6*a* Lower end of bottom end in can axial direction of male threaded portion
7 Skirt portion
7*a* First circumferential wall portion
7*b* Convexly curved surface portion
7*c* Second circumferential wall portion
9 Neck portion
20 Bottle can
22 Bottle can pipe sleeve portion
X Direction in which male threaded portion extends

BEST MODE FOR CARRYING OUT THE INVENTION

Embodiments of this invention will now be described below with reference made to the drawings. Firstly, a description will be given of the schematic structure of a bottle can formed using the bottle can manufacturing method shown as an embodiment of this invention.

As shown in FIG. 1, this bottle can 20 has a schematic structure that is provided with a large diameter drum portion (not shown), a shoulder portion 23 that is joined to a top end in the can axial direction of the drum portion and whose diameter gradually narrows as it moves upwards, and a pipe sleeve portion 22 that is joined to a top end of the shoulder portion 23 and extends upwards. In the pipe sleeve portion 22 are formed a curl portion 8 that is molded such that end portions of the aperture are bent outwards in the radial direction, a male threaded portion 6 that extends in a spiral shape in a circumferential direction towards a center portion in the can axial direction of the pipe sleeve portion 22, and a skirt portion 7 that is joined to a bottom end in the can axial direction of the male threaded portion 6 and protrudes towards the outer side in the radial direction.

Figure 2:
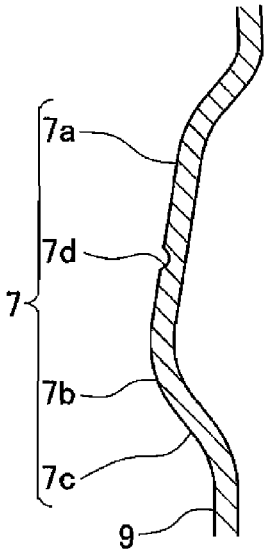
FIG. 2 is an enlarged cross-sectional view of a portion F of the bottle can shown in FIG. 1.

As shown in FIG. 2, the skirt portion 7 is joined to a bottom end in the can axial direction of the male threaded portion 6 and is provided with a first circumferential wall portion 7*a* that is joined to a bottom end in the can axial direction of the male threaded portion 6 and whose diameter becomes gradually larger moving downwards, a convexly curved surface portion 7*b* that is joined to a bottom end of this first circumferential wall portion 7*a* and protrudes towards the outer side in the radial direction, and a second circumferential wall portion 7*c* that is joined to a bottom end of this convexly curved surface portion 7*b* and whose diameter becomes gradually narrower moving downwards. In addition, a neck portion 9 that has a smaller diameter than the convexly curved surface portion 7*b* and that extends downwards is joined to a bottom end of the second circumferential wall portion 7*c*, namely, to a bottom end of the skirt portion 7.

In the above described structure, due to the spiral shape of the male threaded portion 6, the size a in the can axial direction of the skirt portion 7 is not constant in the circumferential direction, but, as shown in FIG. 1, the portion that is located at an lower end 6*a* at the bottom end in the can axial direction of the male threaded portion 6 (referred to below as 'position A in the circumferential direction') is the smallest, and the size a becomes gradually larger moving in a direction X in which the male threaded portion 6 extends in the circumferential direction from the position A. In addition, this size a is the largest at the portion of the lower end 6*a* of the male threaded portion 6 that is located in the vicinity of the opposite side from the extending direction X (referred to below as 'position B in the circumferential direction').

Specifically, of the first circumferential wall portion 7*a*, the convexly curved surface portion 7*b*, and the second circumferential wall portion 7*c* that make up the skirt portion 7, only the size of the first circumferential wall portion 7*a* in the can axial direction differs in the circumferential direction in the manner described above, and the size of the convexly curved surface portion 7*b* and the second circumferential wall portion 7*c* in the can axial direction are uniform over substantially the entire circumference of the pipe sleeve portion 22.

In addition, in the present embodiment, a recessed portion 7*d* that extends in the circumferential direction is formed over the entire circumference of the first circumferential wall portion 7*a* in a portion that is located in an area at least approximately 180° in the opposite direction from the direction X in which this male threaded portion 6 extends in the circumferential direction from the lower end 6*a* at the bottom end in the axial direction of the male threaded portion 6. Moreover, a distance in the can axial direction between this recessed portion 7*d* and the convexly curved surface portion 7*b* is substantially uniform over the entire circumference of the pipe sleeve portion 22. Furthermore, as shown in FIG. 1, the recessed portion 7*d* of the present embodiment is formed continuously over the entire circumference of that portion of the first circumferential wall portion 7*a* that is located below the lower end 6*a* of the male threaded portion 6 in the can axial direction.

Moreover, as shown in FIG. 2, the recessed portion 7*d* of the present embodiment is formed as a recessed groove that is hollowed out as a curved surface towards the inner side in the radial direction only on the outer circumferential surface of the first circumferential wall portion 7*a*, and the inner circumferential surface that corresponds to this position is formed as a smooth surface. Note that the recessed portion 7*d* is formed at a position approximately 1 to 2 mm towards the top in the can axial direction from the end portion on the outer side in the radial direction of the convexly curved surface portion 7*b*. Moreover, the size in the can axial direction of the recessed portion 7*d* is not more than 0.2 mm, and the distance in the radial direction between the outer circumferential surface of the first circumferential wall portion 7*a* and the portion of the outer circumferential surface of the recessed portion 7*d* that is located on the innermost side in the radial direction, namely, the depth of the recessed portion 7*d* is formed between 0.02 mm to 0.10 mm.

Next, a bottle can manufacturing apparatus that is used to mold the male threaded portion 6, the skirt portion 7, and the neck portion 9 of the bottle can 20 that is constructed in the manner described above will be described. The bottle can 5 that is supplied to this manufacturing apparatus is the same as the conventional bottle can shown in FIGS. 7A to 7D described above, and therefore a description thereof is omitted.

Figure 3:
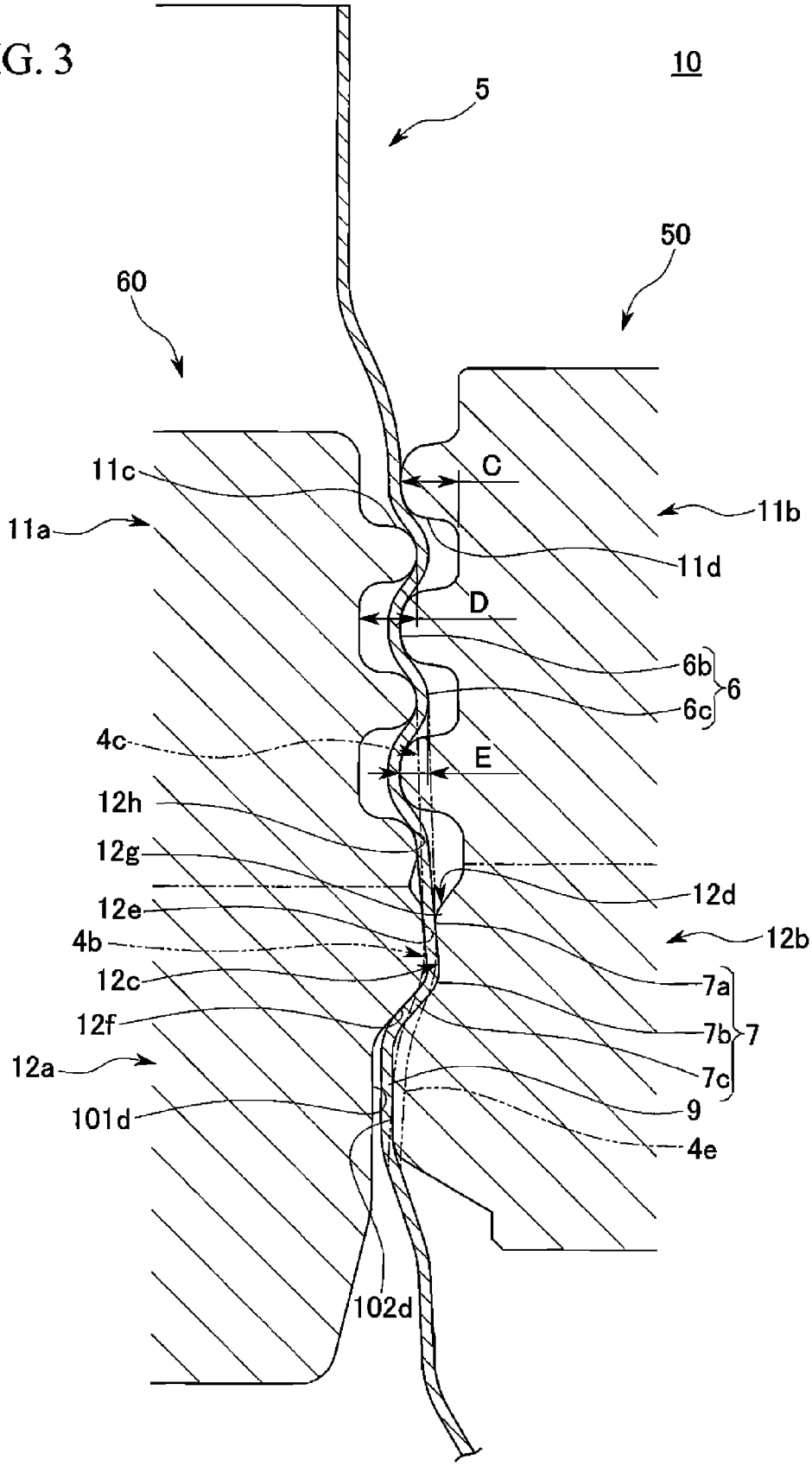
FIG. 3 is an enlarged cross-sectional view showing principal portions of an apparatus for implementing the bottle can manufacturing method as an embodiment of the present invention.
Figure 4:
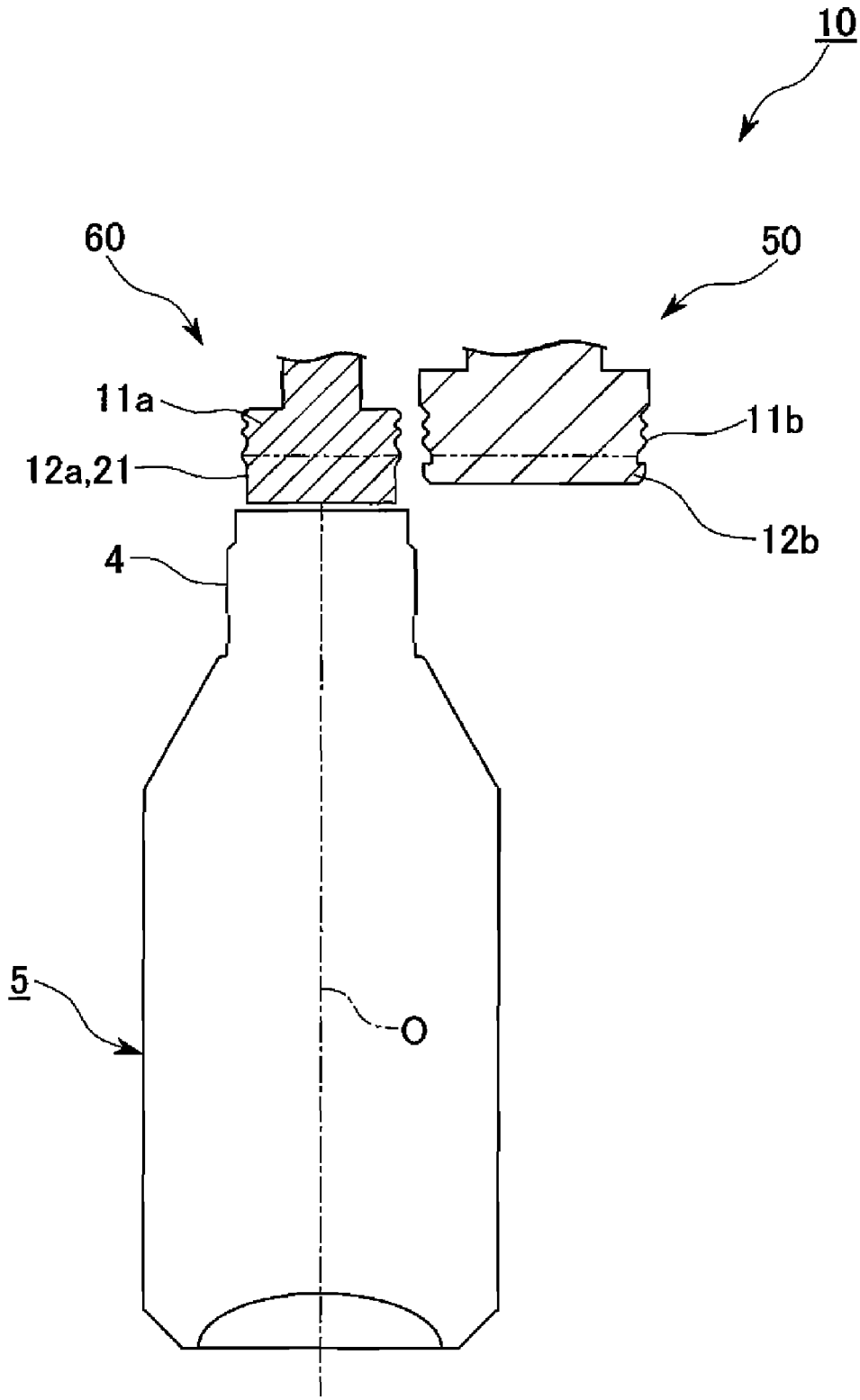
FIG. 4 is a schematic side surface view showing an apparatus for implementing the bottle can manufacturing method as an embodiment of the present invention, and is a view showing a first step.
Figure 5:
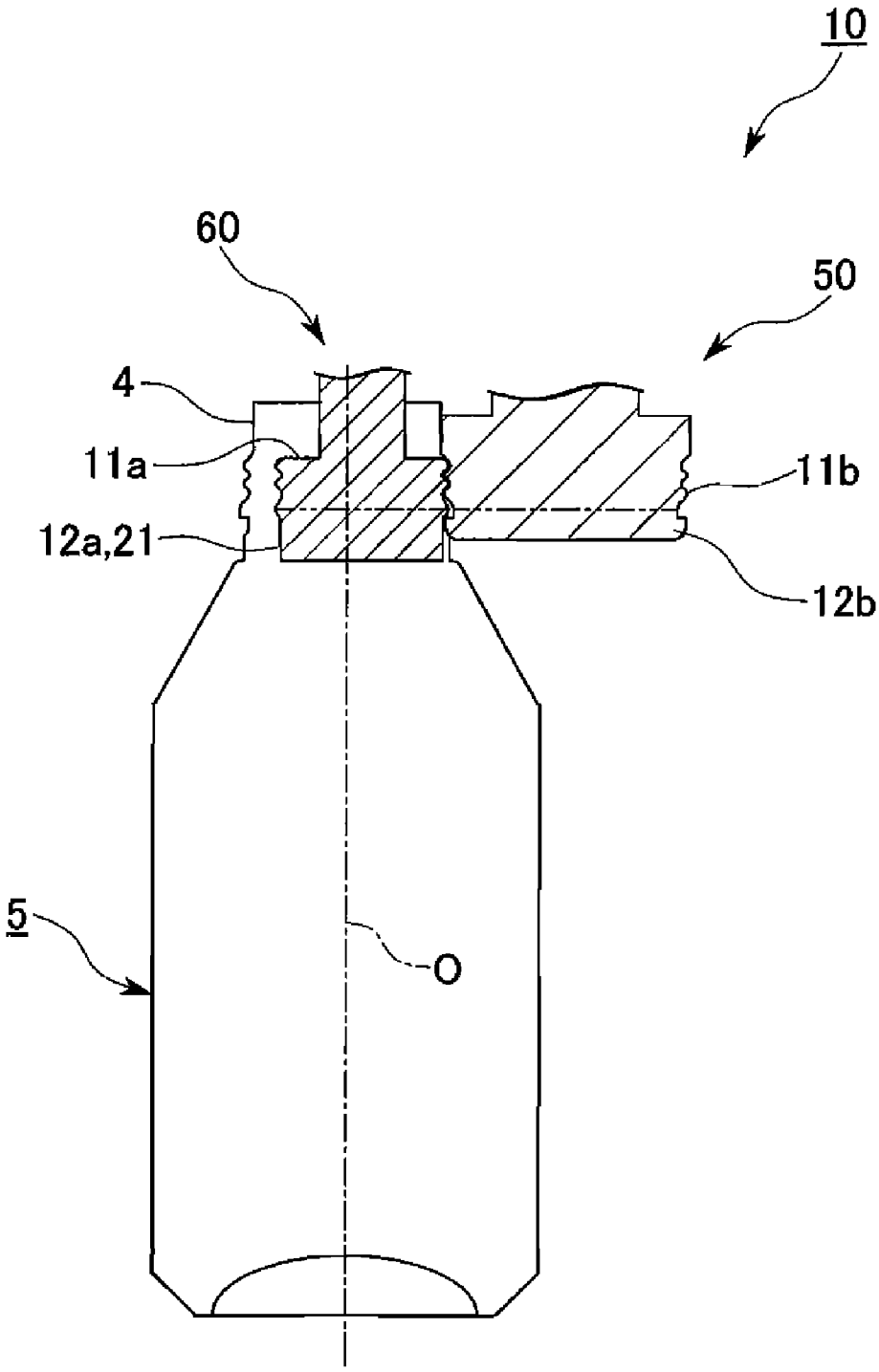
FIG. 5 is a schematic side surface view showing the apparatus for manufacturing a bottle can shown in FIG. 4, and is a view showing a second step.

As shown in FIG. 3 through FIG. 5, a bottle can manufacturing apparatus 10 of the present embodiment is provided with an inner side molding wheel 60 that is placed on the inner side of a pipe sleeve portion 4 of a bottle can body, and an outer side molding wheel 50 that is placed on the outer side thereof. The respective molding wheels 60 and 50 are provided with skirt molding portions 12*a* and 12*b*, and male threaded molding portions 11*a* and 11*b* that are placed coaxially with the skirt molding portions 12*a* and 12*b*. In the present embodiment, bottom portions in the axial direction of the respective molding wheels 60 and 50 form the skirt molding portions 12*a* and 12*b*, while top portions thereof form the male threaded molding portions 11*a* and 11*b*. Furthermore, the respective molding wheels 60 and 50 are supported such that they are able to move in the can axial direction and radial direction towards and away from the pipe sleeve portion 4 of a mounted bottle can body 5, and are also supported such that they are able to rotate freely around their respective axes of rotation.

In order to facilitate the explanation given below, the skirt molding portion 12*a* of the inner side molding wheel 60 is referred to as an 'inner side skirt molding portion 12*a*', the male threaded molding portion 11*a* of the inner side molding wheel 60 is referred to as an 'inner side male threaded molding portion 11*a*', the skirt molding portion 12*b* of the outer side molding wheel 50 is referred to as an 'outer side skirt molding portion 12*b*', and the male threaded molding portion 11*b* of the outer side molding wheel 50 is referred to as an 'outer side male threaded molding portion 11*b*'.

As shown in FIG. 5, from the above structure, after the inner side molding wheel 60 has been placed on the inner side of the pipe sleeve portion 4 and the outer side molding wheel 50 has been placed on the outer side thereof, each of these molding wheels 50 and 60 are moved towards each other so that the pipe sleeve portion 4 is sandwiched between the two. In this state, the wheels 50 and 60 are pivoted around the can axis so that the male threaded portion 6, the skirt portion 7, and the neck portion 9 are molded in the pipe sleeve portion 4.

As shown in FIG. 3, male threaded pressing portions 11*c* and 11*d* of the respective molding portions 11*a* and 11*b* that protrude towards the outer side in the radial direction are formed in a spiral shape on each of the outer circumferential surfaces of the inner side and outer side male threaded molding portions 11*a* and 11*b* and over the entire circumference thereof in the circumferential direction such that the positions of each in the axial direction are offset. In addition, the sizes in the radial direction of the respective male threaded pressing portions 11*c* and 11*d* of the present embodiment from the outer circumferential surfaces of the male threaded molding portions 11*a* and 11*b*, namely, the heights D and C are larger than the height of the thread ridge E of the male threaded portion 6 being molded.

As a result, when the male threaded portion 6 is being molded, the outer circumferential surface of the outer side male threaded molding portion 11*b* and the outer circumferential surface of the thread ridge portion 6*c* of the male threaded portion 6 are not in contact with each other. Moreover the outer circumferential surface of the inner side male threaded molding portion 11*a* and the inner circumferential surface of a valley portion 6*b* of the male threaded portion 6 are not in contact with each other.

The outer side skirt molding portion 12*b* is provided with an outer side pressing portion 102*d* that presses an outer surface side of the neck portion molding pre-form portion 4*e* towards the inner side in the radial direction, and with a supporting portion 12*c* that, during the molding of those portions from among at least a portion of the first circumferential wall portion 7*a*, the convexly curved surface portion 7*b* and the second circumferential wall portion 7*c* that are located in an area (referred to below simply as the 'area') that is at least approximately 180° in the opposite direction from the direction X in which this male threaded portion 6 extends in the circumferential direction from the lower end 6*a* at the bottom end in the can axial direction of the male threaded portion 6 being molded, is pressed against by outer surface portions of each molding pre-form portion of at least a portion of the first circumferential wall portion 7*a*, the convexly curved surface portion 7*b* and the second circumferential wall portion 7*c*, and consequently supports 7*a*, 7*b*, and 7*c*.

The supporting portion 12*c* of the present embodiment is constructed such that it is pressed against substantially continuously in the can axial direction by the outer circumferential surfaces of the respective molding pre-form portions of the bottom portion in the can axial direction of the first circumferential wall portion 7*a*, the convexly curved surface portion 7*b*, and the second circumferential wall portion 7*c* so that it supports these portions 7*a*, 7*b*, and 7*c*, and the outer side pressing portion 102*d* is joined smoothly to the bottom end thereof in the axial direction.

Moreover, the outer side skirt molding portion 12*b* of the present embodiment is provided with a first convexly curved surface portion 12*d* that is joined to a top end in the axial direction of the supporting portion 12*c* and whose diameter becomes gradually narrower moving upwards in the axial direction. Note that a connecting portion 12*g* between the supporting portion 12*c* and the first convexly curved surface portion 12*d* is formed as a curved surface that protrudes towards the outer side in the radial direction, and the radius of curvature thereof is approximately 0.5 mm to 2.0 mm.

As a result of the above, when molding the skirt portion 7, outer surfaces of the respective molding pre-form portions of the bottom portion of the first circumferential wall portion 7*a*, the convexly curved surface portion 7*b*, and the second circumferential wall portion 7*c* are made to press against the supporting portion 12*c* and are thereby supported. In other words, inner surfaces of the respective molding pre-form portions of the bottom portion of the first circumferential wall portion 7*a*, the convexly curved surface portion 7*b*, and the second circumferential wall portion 7*c* are pressed towards the outer side in the radial direction by the inner side skirt molding portion 12*a* (described below), and the outer surfaces corresponding to these are pressed against the outer surface of the supporting portion 12*c* and are thereby supported. Moreover, a top end portion of the bottom portion outer surface of the molding pre-form portion of the first circumferential wall portion 7*a* is pressed towards the inner side in the radial direction by the connecting portion 12*g* of the first convexly curved surface portion 12*d*.

The inner side skirt molding portion 12*a* of the present embodiment is provided with a first inner side pressing portion 12*e* that presses inner surfaces of the respective molding pre-form portions of the bottom portion in the can axial direction of the first circumferential wall portion 7*a* and the convexly curved surface portion 7*b* towards the outer side in the radial direction, and with a bending portion 12*f* that bends the molding pre-form portion of the second circumferential wall portion 7*c* towards the outer side in the radial direction from the inner surface side taking the bottom end portion thereof in the can axial direction as a fulcrum. The first inner side pressing portion 12*e* and the bending portion 12*f* are joined smoothly in the axial direction.

In the present embodiment, the first inner side pressing portion 12*e* and the bending portion 12*f* are formed over the entire circumference of the outer circumferential surface of the inner side skirt molding portion 12*a*. Furthermore, in the present embodiment, the inner side skirt molding portion 12*a* is provided with a second inner side pressing portion 12*h* that presses the inner surface of the molding pre-form portion of the top portion in the can axial direction of the first circumferential wall portion 7*a* towards the outer side in the radial direction.

Next, a description will be given of a method of molding the male threaded portion 6, the skirt portion 7, and the neck portion 9 in the pipe sleeve portion 4 of the bottle can body using the bottle can manufacturing apparatus 10 that is constructed in the manner described above.

Firstly, as shown in FIG. 4, when the bottle can body 5 is held on a holding table (not shown) so that the can axis and a center axis O of the apparatus 10 match each other, the outer side molding wheel 50 and the inner side molding wheel 60 are moved forwards towards the bottle can body 5.

The rotation axis of the inner side molding wheel 60 substantially matches the center axis O of the apparatus 10, and the outer diameter of the inner side molding wheel 60 is smaller than the inner diameter of the pipe sleeve portion 4 of the bottle can body. Moreover, the outer side molding wheel 50 is located at a position where the distance between the rotation axis thereof and the outer circumferential surface of the pipe sleeve portion 4 of the bottle can body is larger than the radius of the outer side molding wheel 50. As a result of this, when the apparatus 10, namely, the inner side molding wheel 60 and the outer side molding wheel 50 are moved forward towards the bottle can body 5 in the can axial direction thereof, the inner side molding wheel 60 is placed on the inner side of the pipe sleeve portion 4 of the bottle can body, while the outer side molding wheel 50 is placed on the outer side of the bottle can pipe sleeve portion 4.

Thereafter, the inner side molding wheel 60 is moved towards the outer side in the radial direction of the bottle can body 5 and the outer molding wheel 50 is moved towards the inner side in the radial direction of the bottle can body 5 using a drive device (not shown) so that the respective molding wheels 50 and 60 are moved in the direction in which they approach each other. As a result, as shown in FIG. 5, the pipe sleeve portion 4 is gripped by the outer surfaces of the respective molding wheels 50 and 60. Of the pipe sleeve portion 4, the male threaded molding pre-form portion 4*c* is gripped by the inner side and outer side male threaded molding portions 11*a* and 11*b*, while the skirt molding pre-form portion 4*b* is gripped by the inner side and outer side skirt molding portions 12*a* and 12*b*.

The inner surface of the male threaded molding pre-form portion 4*c* is pressed towards the outer side in the radial direction by the male threaded pressing portion 11*c* of the inner side male threaded molding portion 11*a* so that the thread ridge portion 6*c* is molded, and the outer surface of the male threaded molding pre-form portion 4*c* is pressed towards the inner side in the radial direction by the male threaded pressing portion 11*d* of the outer side male threaded molding portion 11*b* so that the valley portion 6*b* is formed. Furthermore, at this time, the inner circumferential surfaces of the valley portion 6*b* are not in contact with the outer circumferential surface of the inner side male threaded molding portion 11*a*, and the outer circumferential surfaces of the thread ridge portion 6*c* are not in contact with the outer circumferential surface of the outer side male threaded molding portion 11*b*.

In contrast, of the inner surfaces of the skirt molding pre-form portion 4*b*, the respective molding pre-form portions of the convexly curved surface portion 7*b* and the bottom portion in the can axial direction of the first circumferential wall portion 7*a* are pressed towards the outer side in the radial direction by the first inner side pressing portion 12*e* of the inner side skirt molding portion 12*a*, and the molding pre-form portion of the second circumferential wall portion 7*c* is spent towards the outer side in the radial direction by the bending portion 12*f* of the inner side skirt molding portion 12*a* with the bottom end portion thereof taken as a fulcrum. Furthermore, the inner surface of the top portion in the can axial direction of the molding pre-form portion of the first circumferential wall portion 7*a* is pressed towards the outer side in the radial direction by the second inner side pressing portion 12*h* of the inner side skirt molding portion 12*a*.

Moreover, of the outer surface of the skirt molding pre-form portion 4*b*, the bottom end portion in the can axial direction of the molding pre-form portion of the second circumferential wall portion 7*c* is pressed towards the inner side in the radial direction by the outer side pressing portion 102*d* of the outer side skirt molding portion 12*b*, and the respective molding pre-form portions of the convexly curved surface portion 7*b*, the second circumferential wall portion 7*c*, and the bottom portion in the can axial direction of the first circumferential wall portion 7*a* are pressed against the supporting portion 12*c* of the outer side skirt molding portion 12*b* and are thereby supported. Namely, due to the pressure towards the outer side in the radial direction from the first inner side pressing portion 12*e* of the inner side skirt molding portion 12*a*, outer surfaces of substantially the entire area of the respective molding pre-form portions of the convexly curved surface portion 7*b*, the second circumferential wall portion 7*c*, and the bottom portion in the can axial direction of the first circumferential wall portion 7*a* are pressed against the supporting portion 12 and are thereby supported.

At this time, a top end portion of the outer surface of the bottom portion in the can axial direction of the first circumferential wall portion 7*a*, namely, a position that, in the can axial direction, is below the lower end 6*a* of the male threaded portion 6 is pushed towards the inner side in the radial direction by the connecting portion 12*g* of the first convexly curved surface portion 12*d* of the outer side skirt molding portion 12*b*. Moreover, when an inner surface of the neck portion molding pre-form portion 4*e* is in an unrestrained state, namely, when this inner surface is in a state of non-contact with the outer surface of a portion 101*d* that is joined to a bottom end of the bending portion 12*f* of the inner side skirt molding portion 12*a* and faces the outer side pressing portion 102*d* with the neck portion molding pre-form portion 4*e* sandwiched in-between, then the neck molding pre-form portion 4*e* is pressed towards the inner side in the radial direction.

As is described above, if the apparatus 10 is pivoted around the center axis O thereof while the pipe sleeve portion 4 of the bottle can body is being gripped by the outer side and inner side molding wheels 50 and 60, the male threaded portion 6, the skirt portion 7, and the neck portion 9 are molded over the entire circumference of the pipe sleeve portion 4. In this molding process, a top end portion of the outer surface of the bottom portion of the molding pre-form portion of the first circumferential wall portion 7*a* is pressed towards the inner side in the radial direction over the entire circumference thereof by the connecting portion 12*g* of the first convexly curved surface portion 12*d*. As a result of this, in the outer circumferential surface of the first circumferential wall portion 7*a*, a recessed portion 7*d* such as that shown in FIGS. 1 and 2 is formed in a portion that is located below the lower end 6*a* of the male threaded portion 6 in the axial direction so as to extend continuously over the entire circumference thereof.

Thereafter, by bending an aperture end portion of the pipe sleeve portion 4 of the bottle can body back towards the outer side in the radial direction and thereby molding the curl portion 8 and the like, the bottle can 20 shown in FIG. 1 and FIG. 2 is formed.

As has been described above, according to the bottle can manufacturing method of the present embodiment, during the molding of those portions that are located in an area that is at least approximately 180° in the opposite direction from the direction X in which this male threaded portion 6 extends in the circumferential direction from the lower end 6*a* at the bottom end in the can axial direction of the male threaded portion 6 which is a portion of the skirt portion 7 whose size is large in the can axial direction, because not only the inner surface of the molding pre-form portion of the convexly curved surface portion 7*b* from among the skirt portion molding pre-form portion 4*b*, but also the inner surface of the molding pre-form portion of the first circumferential wall portion 7*a* is pressed towards the outer side in the radial direction, it is possible to prevent the shape of the skirt portion 7 that is located in this area from becoming slack.

Namely, the first circumferential wall portion 7*a* is not molded as a result of only the inner surface of the molding pre-form portion of the convexly curved surface portion 7*b* being pushed towards the outer side in the radial direction, and the molding pre-form portion of the first circumferential wall portion 7*a* being deformed as a result of following the deformation behavior towards the outer side in the radial direction of this convex curved surface portion 7*b*, but instead the first circumferential wall portion 7*a* is molded by the inner surface of the molding pre-form portion of the first circumferential wall portion 7*a* being pushed forcefully towards the outer side in the radial direction so that it becomes deformed in this direction. Because of this, even if this pressing force is removed after the molding, there is no springback action in the first circumferential wall portion 7*a* towards the inner side in the radial direction, and the shape during the pressing can be maintained.

Accordingly, it is possible to mold the skirt portion 7 with the radius of curvature R of the convexly curved surface portion 7*b* as well as the angle θ that is formed in a direction that is orthogonal to the can axis by the outer surface of the second circumferential wall portion 7*c* or by a tangent thereof having a substantially uniform size over the entire circumference.

As a result of this, when the cap has been loosened, any difficulty in once again resealing the bottle can 20 after the diameter of the flare of the cap was enlarged when the cap was opened that is caused by the bridge of the cap that is placed on the skirt portion 7 of the bottle can 20 not being properly broken off, as well as the screwing accuracy when the cap is screwed onto the pipe sleeve portion 22 being irregular at each position in the circumferential direction in the capping process in which the cap is screwed on the pipe sleeve portion 22 after the bottle can 20 has been filled with contents can both be suppressed.

Moreover, when molding the portion located in the area of the skirt portion 7, with the molding pre-form portion of the first circumferential wall portion 7*a* in a state of being supported from the outer surface side by the supporting portion 12*c*, the inner surface corresponding to this outer surface is pressed towards the outer side in the radial direction by the first inner side pressing portion 12*e* and is molded into the first circumferential wall portion 7*a* of the skirt portion 7. Because of this, during this molding, it is possible to prevent any elongation in the can axial direction that is generated in the outer surface of the molding pre-form portion of the first circumferential wall portion 7*a*, and any deformation towards the outer side in the radial direction of the molding pre-form portion of the first circumferential wall portion 7*a* as a result of such elongation is blocked, and it is possible to reliably prevent the springback action from being generated.

Furthermore, when the portion of the skirt portion 7 that is located in the area is being molded, because the recessed portion 7*d* is formed in the first circumferential wall portion 7*a*, the pressing force towards the outer side in the radial direction against the inner surfaces of the respective molding pre-form portions of the first circumferential wall portion 7*a* and the convexly curved surface portion 7*b* can be prevented from being dispersed upwardly in the can axial direction above the recessed portion 7*d*. Accordingly, it is possible to apply this pressing force such that it is concentrated on the respective molding pre-form portions of the bottom portion of the first circumferential wall portion 7*a* and the convexly curved surface portion 7*b* that are located below the recessed portion 7*d*, and it is possible to reliably prevent the shape of the skirt portion 7 that is located in the area from becoming slack.

Moreover, when the skirt portion 7 that is located in the area is being molded, because the molding pre-form portion of the second circumferential wall portion 7*c* is bent, it is possible to perform work hardening on the bottom end portion in the can axial direction of the second circumferential wall portion 7*c* that is being molded. Accordingly, when the pressure towards the outer side in the radial direction against the inner surfaces of the respective molding pre-form portions of the first circumferential wall portion 7*a* and the convexly curved surface portion 7*b* is released after the molding has been completed, even if a springback action starts to be generated towards the inner side in the radial direction in the first circumferential wall portion 7*a* and the convexly curved surface portion 7*b*, the bottom end portion in the can axial direction of the second circumferential wall portion 7*b* that has undergone the work hardening can be made to act as a reinforced portion that resists the springback action.

Furthermore, during the molding of the portion of the skirt portion 7 that is located in the area, because the molding pre-form portion of the convexly curved surface portion 7*b* is molded into the convexly curved surface portion 7*b* with the molding pre-form portion of the convexly curved surface portion 7*b* in a state of being supported from the outer surface side thereof, and the inner surface that corresponds to this outer surface being pressed towards the outer side in the radial direction, it is possible during this molding to suppress any elongation in the can axial direction that is generated on the outer surface of the molding pre-form portion of the convexly curved surface portion 7*b*, and any deformation towards the outer side in the radial direction of the molding pre-form portion of the convexly curved surface portion 7*b* that would have been caused by this elongation is blocked. Alternatively, when the pressure towards the outer side in the radial direction against the inner surface of the molding pre-form portion of the convexly curved surface portion 7*b* is released after the molding, it is possible to reliably prevent the springback action towards the inner side in the radial direction of the convexly curved surface portion 7*b* from being generated.

Moreover, because the molding pre-form portion of the second circumferential wall portion 7*c* is bent while being supported from the outer surface side thereof, during the molding, it is possible to suppress any compressive strain in the direction in which the longitudinal cross-section configuration extends that is generated on the outer surface of the bottom end portion of the molding pre-form portion of the second circumferential wall portion 7*c*, and when the bending of the molding pre-form portion of the second circumferential wall portion 7*c* is released after the molding, it is possible to reliably suppress the springback action of the second circumferential wall portion 7*c* towards the top in the can axial direction.

As a result of the above, even if the respective molding wheels 50 and 60 are moved away from the pipe sleeve portion 4 after the molding, all of the first circumferential wall portion 7*a*, the convexly curved surface portion 7*b*, and the second circumferential wall portion 7*c* that make up the skirt portion 7 can be substantially maintained in the shape they were in during the molding, and it is possible to accurately form the skirt portion 7.

Moreover, in the present embodiment, when the recessed portion 7*d* is formed in the first circumferential wall portion 7*a*, the outer surface of this circumferential wall portion 7*a* is pressed towards the inner side in the radial direction by the connecting portion 12*g* of the first convexly curved surface portion 12*d* of the outer side skirt molding portion 12*b*, and the inner surface corresponding to this is pressed towards the outer side in the radial direction by the first inner side pressing portion 12*e* of the inner side skirt molding portion 12*a*, so that these inner and outer surfaces are firmly gripped.

Accordingly, as is described above, in conjunction with the work hardening of the bottom end portion of the second circumferential wall portion 7*c*, during the molding of the skirt portion 7, the pressing force towards the outer side in the radial direction against the inner surface of the respective molding pre-form portions of the first circumferential wall portion 7*a* and the convexly curved surface portion 7*b* can be prevented from being dispersed both above the recessed portion 7*d* in the can axial direction and below the bottom end portion of the second circumferential wall portion 7*c*, and it is possible to apply this pressing force such that it is concentrated on the respective molding pre-form portions of the bottom portion of the first circumferential wall portion 7*a* and the convexly curved surface portion 7*b* that are located between the recessed portion 7*d* and the second circumferential wall portion 7*c*. Accordingly, it is possible to mold the skirt portion 7 with an even greater degree of accuracy.

Furthermore, when the male threaded portion 6 is being molded in the male threaded molding pre-form portion 4*c*, because the inner circumferential surfaces of the valley portions 6*b* and the outer circumferential surfaces of the thread ridge portions 6*c* are not in contact with the respective male threaded molding portions 11*a* and 11*b*, it is possible to prevent the male threaded portion 6 undergoing compressive deformation in the thickness direction during molding and thereby making this thickness thinner, and it is possible to prevent any reduction in the buckling strength of the male threaded portion 6.

If the male threaded portion 6 is molded with the inner circumferential surfaces of the valley portions 6*b* and the outer circumferential surfaces of the thread ridge portions 6*c* of the male threaded portion 6 not in contact with each other, because the restraining of the respective molding wheels 50 and 60 by the pipe sleeve portion 4 of the bottle can body is relaxed by the same amount as the increase in the non-contact surface area, the tilt in the axes of rotation of the respective molding wheels 50 and 60 varies at each position in the circumferential direction of the pipe sleeve portion 4 during molding. As a result, it may be considered that there is a possibility that the height E of the thread ridges at each position in the circumferential direction will be inconsistent, and that it will be difficult to mold the male threaded portions 6 with a high degree of accuracy.

However, in the present embodiment, because the male threaded portion 6 is molded with the inner and outer surfaces of the bottom portion of the first circumferential wall portion 7*a*, the convexly curved surface portion 7*b*, and the second circumferential wall portion 7*c* sandwiched between the respective molding wheels 50 and 60, it becomes possible to satisfactorily secure the required constraint of the respective molding wheels 50 and 60 by the pipe sleeve portion 4 of the bottle can body, and it becomes possible to suppress any variation in the tilt of the axes of rotation of the respective molding wheels 50 and 60 at each position in the circumferential direction of the pipe sleeve portion 4 during molding. Accordingly, it becomes possible to suppress any unevenness in the height E of the thread ridges at each position in the circumferential direction, and it becomes possible to mold a male threaded portion 6 with a high degree of accuracy.

In particular, in the present embodiment, because the male threaded portion 6 is molded with the skirt portion 7 being molded while the molding pre-form portion of the second circumferential wall portion 7*c* is bent towards the outer side in the radial direction from the inner surface side thereof with the bottom end portion in the can axial direction thereof taken as a fulcrum, so that the respective skirt molding portions 12*a* and 12*b* are in surface contact with the inner and outer surfaces of the second circumferential wall portion 7*c*, even if the respective skirt molding portions 12*a* and 12*b* start to become tilted relative to their respective axes of rotation during molding, it becomes possible to prevent this tilt from occurring using the frictional force that is generated between the pipe sleeve portion 4 of the bottle can body and the respective molding wheels 50 and 60, so that it is possible to reliably mold the male threaded portion 6 with a high degree of accuracy.

Figure 8:
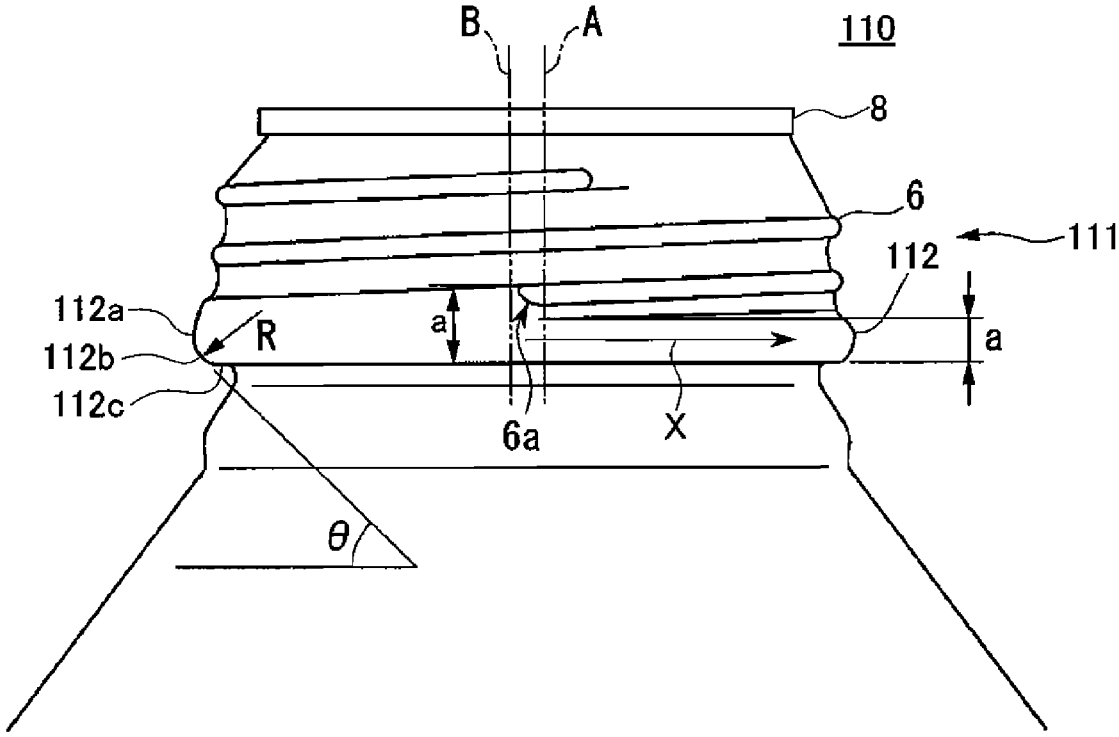
FIG. 8 is an enlarged side surface view showing a bottle can formed using the bottle can manufacturing method as a conventional example according to the present invention.

In the above described operational effects, an evaluation test was performed on whether or not it was possible to form the male threaded portion 6 and the skirt portion 7 with a high degree of accuracy. The evaluation method involved preparing 20 of the bottle cans 20 shown in FIG. 1, and then measuring the skirt angle θ (see FIG. 1) as well as the thread ridge height E (see FIG. 3) at three different optional positions in the circumferential direction in each of the bottle cans 20. As a comparative example, using the bottle can 110 shown in FIG. 8 as an example of the conventional technology, the skirt angle θ and the thread ridge height E were measured in the same way.

The results showed that, in the comparative example, the angle θ had a standard deviation of 3.398, while in the bottle cans 20 of the present embodiment, the standard deviation was 1.549. Moreover, in the comparative example, the thread ridge height E had a standard deviation of 0.075, while in the bottle cans 20 of the present embodiment, the standard deviation was 0.021.

From the above it was confirmed in the examples that it is possible to form a male threaded portion 6 and a skirt portion 7 with a high degree of accuracy.

Note that the technology range of the present invention is not limited to the above described embodiment, and various modifications may be made thereto insofar as they do not depart from the spirit or scope of the present invention.

For example, as shown in FIG. 2, in the above described embodiment, a structure is shown in which the recessed portion 7*d* is formed as a recessed groove that is hollowed out as a curved surface towards the inner side in the radial direction only on the outer circumferential surface of the first circumferential wall portion 7*a*, and the inner circumferential surface that corresponds to this position is formed as a smooth surface, however, it is also possible to form the recessed portion 7*d* such that it is hollowed towards the inner side in the radial direction not only on the outer circumferential surface of the first circumferential wall portion 7*a*, but also on the inner circumferential surface as well. Moreover, instead of the recessed portion 7*d* shown in FIG. 2, it is also possible to form the shape of the recessed portion 7*d* as a V-shape when viewed in longitudinal cross section.

Moreover, the recessed portion 7*d* is formed continuously over the entire circumference of that portion of the first circumferential wall portion 7*a* that is located below the lower end 6*a* of the male threaded portion 6 in the can axial direction, however, provided that it is formed in at least the 180° area, the position where it is formed in the can axial direction is not particularly restricted. Moreover, it is also possible for the recessed portion 7*d* to be interspersed intermittently in the circumferential direction in the first circumferential wall portion 7*a*.

Moreover, in the above described embodiment, the recessed portion 7*d* is formed by pressing the outer surface of the molding pre-form portion of the first circumferential wall portion 7*a* that is located in the area, however, it is also possible for this recessed portion 7*d* to not be formed. Furthermore, when the skirt portion 7 that is located in the area is being molded, the first circumferential wall portion 7*a* and the convexly curved portion 7*b* are molded by pressing the inner surfaces of the respective molding pre-form portions of the first circumferential wall portion 7*a* and the convexly curved surface portion 7*b* towards the outer side in the radial direction while the outer surface sides thereof are being supported, however, it is also possible for them to be molded by pressing the inner surface sides towards the outer side in the radial direction without supporting the outer surface sides thereof.

Furthermore, when the skirt portion 7 that is located in the area is being molded, the molding pre-form portion of the second circumferential wall portion 7*c* is molded into the second circumferential wall portion 7*c* by being bent from the inner surface side thereof while the outer surface side thereof is supported, however, it is also possible to bend the inner surface side without supporting the outer surface side thereof. Alternatively, it is also possible to mold the second circumferential wall portion 7*c* without restraining the inner and outer surfaces of these molding pre-form portions, by pressing the inner surface of the respective molding pre-form portions of the first circumferential wall portion 7*a* term and the convexly curved surface portion 7*b* towards the outer side in the radial direction, and causing the molding pre-form portion of the second circumferential wall portion 7*c* to be deformed while following the deformation behavior towards the outer side in the radial direction of the first circumferential wall portion 7*a* and the convexly curved surface portion 7*b*.

Figure 6:
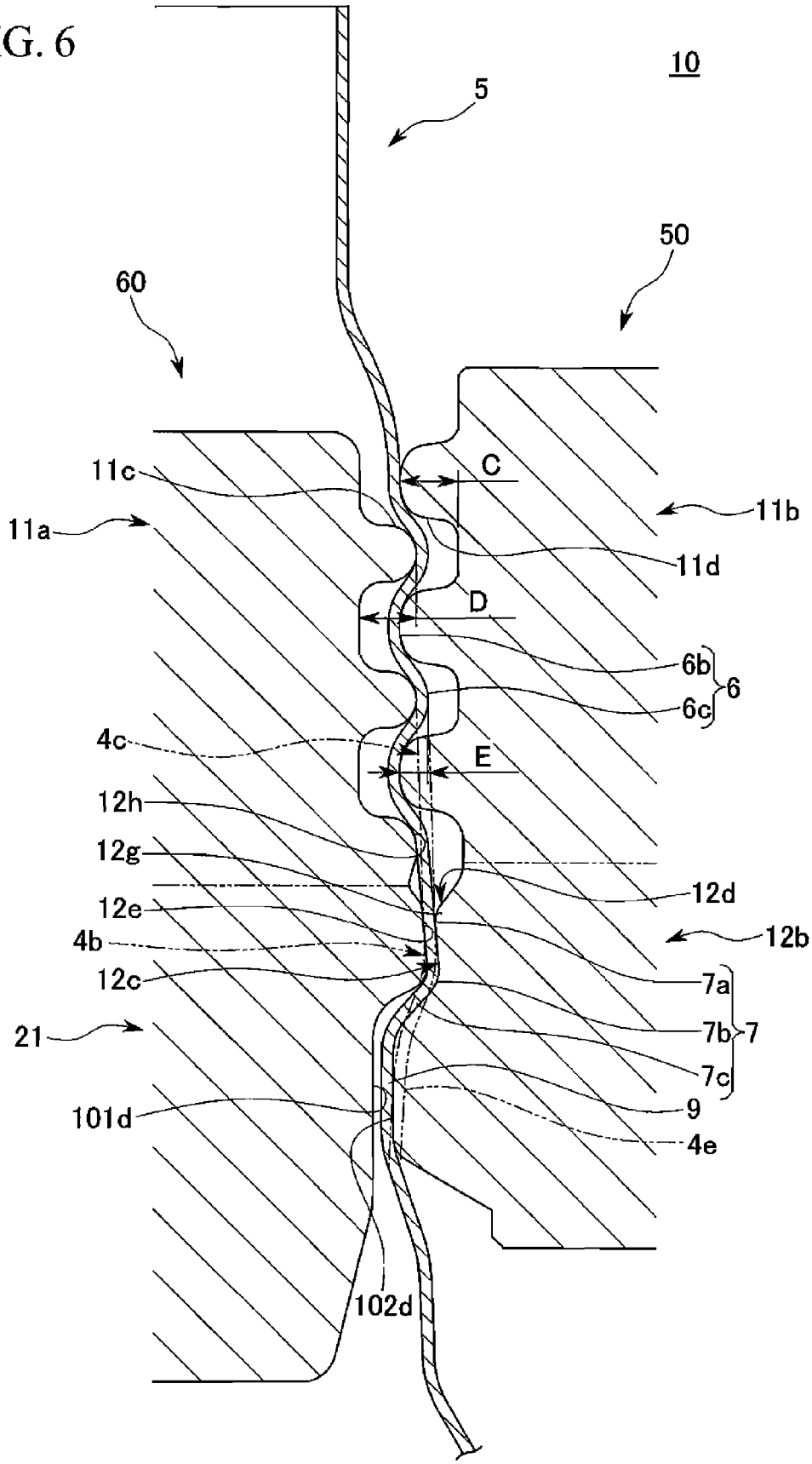
FIG. 6 is an enlarged cross-sectional view showing principal portions of an apparatus for implementing the bottle can manufacturing method as another embodiment of the present invention.
Figure 7A:
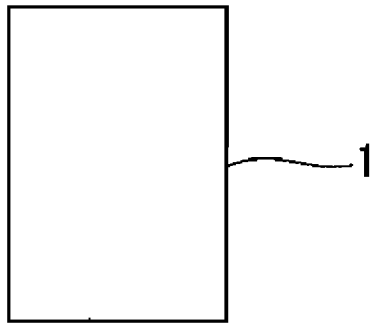
FIG. 7 is a process diagram showing steps for forming a bottle can from a close-ended cylinder body.
Figure 7B:
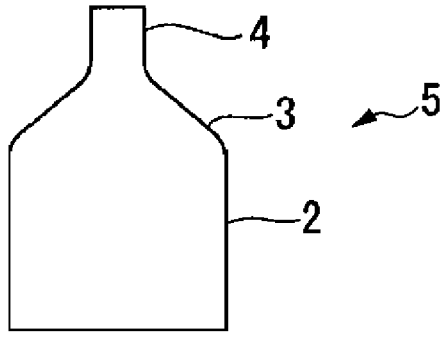
Figure 7C:
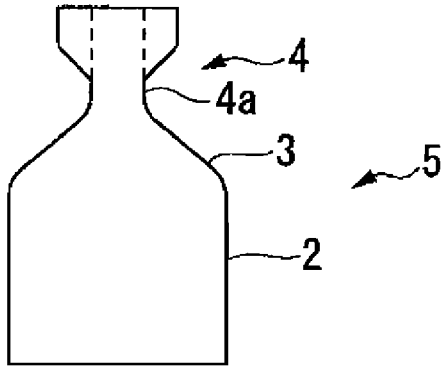
Figure 7D:
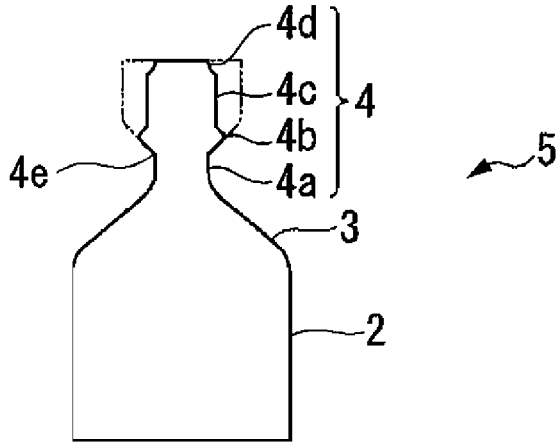

Moreover, as shown in FIG. 6, it is also possible to employ an inner side skirt molding portion 21 that does not have the bending portion 12*f* and, without restraining the inner surface of the molding pre-form portion of the second circumferential wall portion 7*c*, to otherwise mold the skirt portion 7 in the same way as in the above described embodiment shown in FIG. 3.

In this type of structure as well, it was able to be confirmed using the same evaluation method as that described above that the standard deviation in the skirt angle θ was 1.671, and the standard deviation in the thread ridge height E was 0.038. As a result, it was able to be confirmed that, even if the inner side skirt molding portion 21 shown in FIG. 6 is employed, advantageous operational effects are obtained compared to the comparative example.

Furthermore, in the above described embodiment, the neck portion 9 was molded by pressing the outer surface of the neck portion molding pre-form portion 4*e* towards the inner side in the radial direction without restraining the inner surface of the neck portion molding pre-form portion 4*e*, however, when at least the portion of the skirt portion 7 that is located in the area is being molded, it is also possible, while supporting the neck portion molding pre-form portion 4*e* from the inner surface side thereof, to mold the neck portion 9 by pressing the outer surface that corresponds to this inner surface towards the inner side in the radial direction.

In this case, during the molding of the neck portion 9, it is possible to prevent any elongation in the can axial direction that is generated in the inner surface of the neck portion molding pre-form portion 4*e*, and any deformation towards the inner side in the radial direction of the neck portion molding pre-form portion 4*e* as a result of such elongation is blocked, or when the respective molding wheels 50 and 60 are moved away from the pipe sleeve portion 22 after the molding, it is possible to prevent the neck portion 9 from springing back towards the outer side in the radial direction. As a result, it is possible to mold the neck portion 9 with a high degree of accuracy, and prevent any distortion in the shape of the neck portion 9 from affecting the skirt portion 7. It is therefore possible to mold an extremely accurate skirt portion with an even greater level of reliability.

INDUSTRIAL APPLICABILITY

The bottle can manufacturing method is provided that makes it possible to mold a skirt portion in a pipe sleeve portion with a high degree of reliability.

The invention claimed is:

1. A method of manufacturing a bottle can having a drum portion with a shoulder portion mounted thereon, the shoulder portion having a neck portion with a pipe sleeve portion, comprising the steps of:

A) molding a skirt portion at the pipe sleeve portion of the bottle can, said molded skirt portion including an area that extends from a lower end of a male threaded portion in an opposite direction from which the male threaded portion extends over a range of at least approximately 180° along a circumferential direction from the lower end;

B) molding a first circumferential wall portion at the skirt portion so as to be in contact with a bottom end of the male threaded portion, the diameter of the first circumferential wall portion being gradually enlarged as it moves downwards in the can axial direction;

C) molding a convexly curved surface portion at the skirt portion so as to be adjacently joined to a bottom end of the first circumferential wall portion, the convexly curved surface portion protruding towards an outer side in the radial direction of a bottle can body and having a diameter larger than that of the bottom end of the first circumferential wall portion; and D) molding a second circumferential wall portion at the skirt portion so as to be adjacently joined to a bottom end of the convexly curved surface portion, the diameter of the second circumferential wall portion being gradually reduced as it moves downward, wherein the skirt portion is a circular protrusion comprising the first circumferential wall portion, the convexly curved surface portion, and the second circumferential wall portion, and the first circumferential wall portion and the convexly curved surface portion are molded by pressing forcefully their inner surfaces outward in the radial direction of the bottle can body.

2. The bottle can manufacturing method according to claim 1, wherein when the area of the skirt portion is in a molding process, a first portion that is to become the first circumferential wall portion is supported from the outer surface side thereof.

3. The bottle can manufacturing method according to claim 2, wherein, when the area of the skirt portion is in a molding process, at least the outer surface of the first portion that is to become the first circumferential wall portion is pressed towards the inner side in the radial direction, and thereby a recessed portion that is hollowed out towards the inner side in the radial direction is formed in the first circumferential wall portion.

4. The bottle can manufacturing method according to claim 3, wherein when the area of the skirt portion is in a molding process, a second portion that is to become the second circumferential wall portion is bent outward in the radial direction from the inner surface side with a bottom end portion in the axial direction thereof forming a fulcrum.

5. The bottle can manufacturing method according to claim 4, wherein when the area of the skirt portion is in a molding process, at least one of a third portion that is to become the convexly curved surface and the second portion that is to become the second circumferential wall portion is supported from the outer surface side thereof.

6. The bottle can manufacturing method according to claim 5, wherein when the area of the skirt portion is in a molding process, a fourth portion that is to become the neck portion that is joined to a bottom end of the second portion that is to become the second circumferential wall portion in the can axial direction is molded into the neck portion that is joined to a bottom end of the skirt portion by pressing an outer surface thereof inward in the radial direction while supporting the fourth portion that is to become the neck portion from the inner surface side thereof.

7. The bottle can manufacturing method according to claim 1, wherein the pipe sleeve portion of the bottle can is pinched between an inner molding wheel placed on an inner side of the pipe sleeve portion and an outer molding wheel placed on an outer side of the pipe sleeve portion, and the first circumferential wall portion, the convexly curved surface portion and the second circumferential wall portion are simultaneously formed by coordinated rotations of the inner molding wheel and the outer molding wheel.

8. The bottle can manufacturing method according to claim 1, wherein the inner surfaces of the first circumferential wall portion and the convexly curved surface portion are pressed outwardly while a portion located at the skirt portion is being molded, the portion extending in an opposite direction in which the male threaded portion extends from a lower end of the male threaded portion over a range of at least approximately 180° along a circumferential direction of the skirt portion.

* * * * *